United States Patent [19]

Kaufer

[11] 4,103,367

[45] Aug. 1, 1978

[54] CHEMICAL DISPENSER FOR URINALS

[76] Inventor: Leo Kaufer, 14144 Dickens St., Sherman Oaks, Calif. 91423

[21] Appl. No.: 782,948

[22] Filed: Mar. 30, 1977

[51] Int. Cl.[2] ..... E03D 9/02

[52] U.S. Cl. ..... 4/222; 4/309

[58] Field of Search ..... 4/109, 222, 223, 231, 4/DIG. 5, 261, 294; D23/150; 210/163-166

[56] References Cited

U.S. PATENT DOCUMENTS

| | | | |
|---|---|---|---|
| 1,880,962 | 10/1932 | Koppelman | 4/109 |
| 1,916,357 | 7/1933 | Brownstein | 4/109 |
| 1,966,074 | 7/1934 | Fuld | 4/109 |
| 1,999,277 | 4/1935 | Boosey | 210/163 |
| 3,538,520 | 11/1970 | Leavitt | 4/222 |
| 3,597,772 | 8/1971 | Leavitt et al. | 4/222 |
| 3,760,429 | 9/1973 | Brownstein | 4/222 X |
| 3,824,633 | 7/1974 | Vlahakis | 4/109 |

*Primary Examiner*—William D. Martin, Jr.
*Assistant Examiner*—Stuart S. Levy
*Attorney, Agent, or Firm*—I. Morley Drucker

[57] ABSTRACT

This invention is directed to a dispensing container for solid deodorant and/or disinfectant media, for use in urinals having a flush water system. The chemical dispensing container comprises a generally flat plate or screen having a perforate central portion and a perforate peripheral portion. An imperforate cover overlies the perforate central portion and contains therewithin the solid deodorant and/or disinfectant media. Cooperating fastening means are provided on said imperforate cover and said underlying plate to enable the cover to be releasably engaged to said plate. A lug support means is also provided, affixed to either of said cover or plate, to prevent abutment of the cover to said plate forming thereby a continuous peripheral channel immediately adjacent and below said cover whereby the flush water path of the urinal includes passage of flush water from the underside of the plate upwardly through the central perforate portion thereof into the interior of the imperforate cover, and outwardly through the continuous peripheral channel. In following this path, the flush water contacts the undersurface of the solid deodorant and disinfectant media, dissolves a portion of the same, and as it passes peripherally outwardly through the channel formed between cover and plate, the dissolved deodorant and disinfectant effectively causes deodorant and disinfectant action to occur over a large surface area of the bowl of the urinal surrounding the solid media.

5 Claims, 5 Drawing Figures

CHEMICAL DISPENSER FOR URINALS

BACKGROUND OF THE INVENTION

Urinal screens or strainers have been heretofore proposed in which solid deodorant and/or disinfectant blocks of chemicals have been held. Such cakes are slowly solubilized, by means of urinal flush water and enable deodorant and/or disinfecting action to take place in the urinal. Prior art patents, teaching one or more of the above aspects, are set forth below:

| U.S. Pat. No. | PATENTEE | ISSUE DATE |
|---|---|---|
| 3,824,633 | Van Vlahakis | 7-23-74 |
| 3,597,772 | Leavitt et al. | 8-10-71 |
| 3,538,520 | Leavitt | 11-10-70 |
| 3,760,429 | Brownstein | 9-25-73 |
| 1,880,962 | Koppelman | 10-4-32 |
| 1,731,431 | Meyer | 10-15-29 |

None of the foregoing patents, however, provide for a structural arrangement wherein the flush water in the urinal can carry the solubilized deodorant/disinfectant block over a large surface of the urinal during the flush, while still protecting the chemical block from the direct action of the urine.

SUMMARY OF THE INVENTION

The chemical dispensing container of this invention comprises a generally flat plate or screen having a perforate central portion and a perforate peripheral portion. An imperforate cover overlies the perforate central portion and contains therewithin the solid deodorant and/or disinfectant media. Cooperating fastening means are provided on said imperforate cover and said underlying plate to enable the cover to be releasably engaged to said plate.

A lug support means is also provided, affixed to either of said cover or plate, to prevent abutment of said cover to said plate and forms thereby a continuous peripheral channel immediately adjacent and below said cover whereby the flush water path of the urinal includes passage of flush water from the underside of the plate upwardly through the central perforate portion thereof into the interior of the imperforate cover, and outwardly through the continuous peripheral channel. In following this path, the flush water contacts the undersurface of the solid deodorant and disinfectant media, dissolves a portion of the same, and as it passes peripherally outwardly through the channel formed between cover and plate, the dissolved deodorant and disinfectant effectively causes deodorant and disinfectant action to occur over a large surface area of the bowl of the urinal surrounding the solid media.

The imperforate cover is preferably made of a domed configuration, as viewed in side elevation and effectively prevents any solubilization of the chemical block by direct action of urine. All parts of the container are preferably constructed of a plastic material inert to water, urine, and the deodorant and disinfectant chemicals employed.

DETAILED DESCRIPTION OF THE INVENTION

Figure 1:
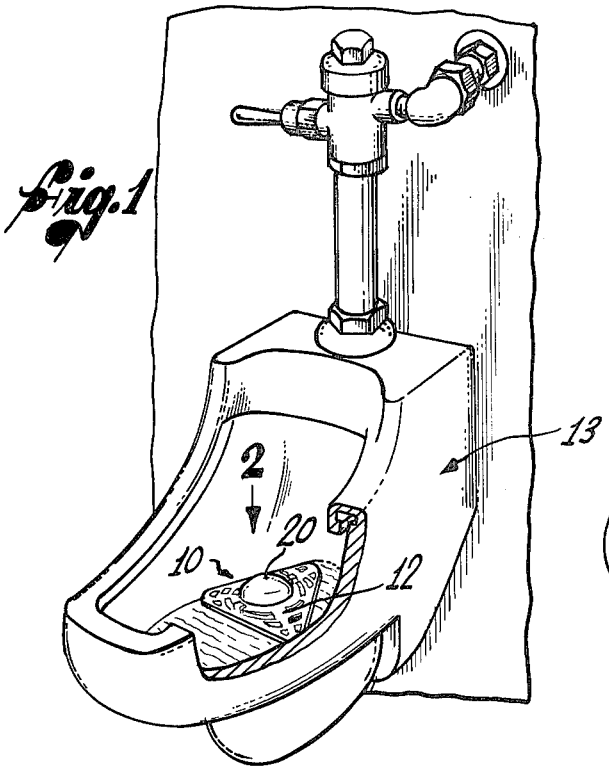
FIG. 1 is a perspective view of the urinal chemical dispenser of this invention, shown as it is normally placed in a urinal.
Figure 3:
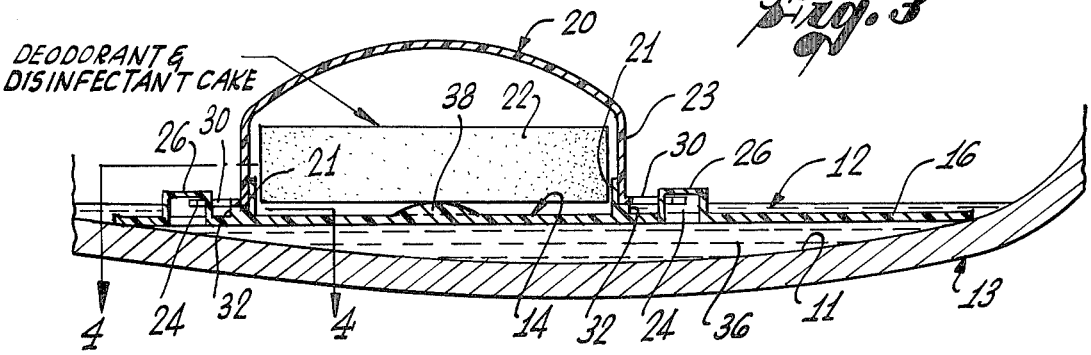
FIG. 3 is a side elevational view of the urinal chemical dispenser, taken along the line 3—3 of FIG. 2.

The chemical dispenser of this invention is designated generally by the numeral 10, and is shown supported in the concave floor 11 of the urinal 13. (See FIGS. 1 and 3). The chemical dispenser 10 comprises a generally flat plastic plate or screen 12 having a perforate central portion 14 and a perforate peripheral portion 16. An imperforate, plastic, domed, cover 20 overlies the perforate central portion 14 and contains therewithin a solid deodorant and/or disinfectant chemical block 22. Cooperating hook and eye fastening means 24, 26 are provided on the imperforate domed cover 20 and said underlying plate 12 to enable the cover 20 to be releasably engaged to the plate.

The perforate central portion 14 of the plate is defined by an upstanding circular collar 21. The collar 21 is spaced from the upper surface of the plate 12 by means of a series of spaced lug support means 32 so as to provide little, if any, obstruction to the flow of water from the central portion 14 of the plate 12, under the collar 21, to the peripheral portions 16 of the plate 12. The domed cover 20 has an inner diameter slightly larger than the outer diameter of the collar 21, and the collar thus accurately positions and aligns the domed cover over the central perforate area 14 of the plate 12.

The domed cover 20 is preferably provided with a circular, generally horizontal, flange 30 extending substantially completely around the lower edge of the vertically extending wall 23 of the cover. The circular flange 30 is spacedly supported from the plate 12 by the series of aforedescribed plastic upraised lug supports 32 which are preferably integrally formed in the peripheral portion 16 of the plate 12, immediately adjacent and external to the collar 21.

Figure 2:
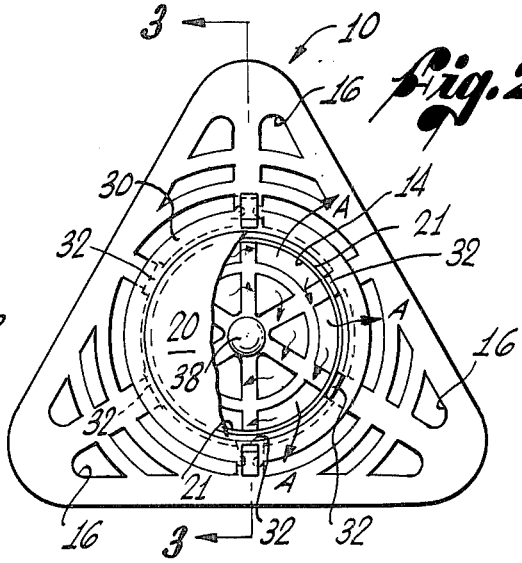
FIG. 2 is a top plan view, taken partially in section, of the urinal chemical dispenser, as seen in the direction indicated by the arrow numbered 2.

The lug support means 32 prevent abutment of the domed cover 20 to the plate 12, resulting in the formation of a substantially continuous peripheral channel immediately and below the flange 30 of cover 20. The flush water path of the urinal includes passage of flush water 36 from the underside of the plate 12 upwardly through the central perforate portion 14 thereof into the interior of the imperforate cover 20, and outwardly through the thusly formed continuous peripheral channel. In following this path, the flush water contacts the under surface of the solid deodorant and disinfectant block 22, dissolves a portion of the same, and as it passes peripherally outwardly through the channel formed between cover 20 and plate 12, the dissolved deodorant and disinfectant effectively causes deodorant and disinfectant action to occur over a large surface area of the bowl of the urinal surround the solid block. The flush water path, under the collar 21 and flange 30, i.e., through the peripheral channel, is designated by the arrows A in FIGS. 2 and 4.

The solid block 22 advantageously is supported within the collar 21 on a central button 38, so that the flush water can readily enter the interior of the cover 20 and readily solubilize the under surface of the block 22 prior to passing peripherally outwardly under the collar 21 and under the flange 30 of the domed cover 20.

All parts of the chemical dispenser 10 are preferably made of a plastic material inert to water, urine, and the chemicals contained in the block 22. The imperforate cover 20 is preferably constructed of a domed shape to minimize fluid splatter. The cooperating fastening means 26, 24 are preferably integrally formed with the plate 12 and cover 20 respectively. Both the hook and eye portions 24, 26 are flexible so as to allow for ready mating and disengagement. The collective length of the lug support means 32 for the collar 21 and for the domed cover 20 constitutes a minor fraction of the total peripheral length of the collar 21 and cover 20 thereby enabling substantially free flow of flush water containing deodorant and/or disinfectant chemical dissolved therein from the interior of the dispenser 10 to the surrounding urinal area.

Figure 4:
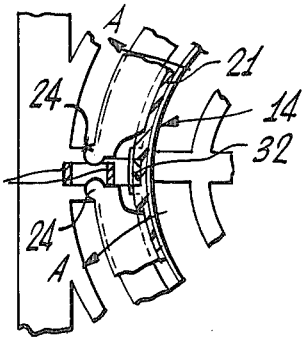
FIG. 4 is a fragmentary top plan view, partially in cross-section, and taken along the line 4—4 of FIG. 3.
Figure 5:
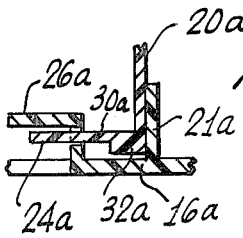
FIG. 5 is an enlarged, fragmentary, side sectional view, in cross section, of an alternative embodiment of the urine discharge dispenser of this invention.

FIG. 5 depicts an alternative embodiment wherein lug means 32*a* depends from cover 20*a* thereby positively preventing abutment of cover 20*a* with plate 16*a*, thereby enabling a peripheral flow-through passage of flush water along the same flow lines A, A as shown in FIG. 4.

The structure described herein more efficiently enables the flush water to deodorize and disinfect urinal bowls by, among other things, enabling the flush water to pass peripherally outwardly, after it has solubilized a portion of the chemical block, to cleanse and deodorize the surrounding urinal bowl surface — while at the same time positively preventing direct contact of urine with the chemical block by means of the domed cover.

The structure of this invention also greatly facilitates servicing by enabling the service person to insert a fresh deodorant/disinfectant cake (or solid granular material contained within a fine mesh pouch) into the dispensing container by merely releasing the fastening means 26, 24 and placing the solid media within the collar 21.

I claim:

1. A dispensing container for solid deodorant and/or disinfectant media, for use in urinals, which comprises:

a generally flat plate having a perforate central portion and a perforate peripheral portion;

an imperforate cover adapted to contain therewithin said solid media and being provided with a peripheral flange therearound;

cooperating fastening means on said imperforate cover and said plate for releasably engaging said imperforate cover with said plate in overlying relationship with said perforate central portion of said plate; and lug means affixed to said plate and lying in abutment with said peripheral flange of said cover thereby prevening abutment of said cover to said plate and forming a substantially continuous peripheral channel immediately adjacent and below said cover whereby the flush water path includes passage of flush water from the underside of the plate upwardly through the central porforate portion thereof, into the interior of the imperforate cover, and outwardly through the peripheral channel formed immediately below said cover.

2. The dispensing container of claim 1 wherein said plate and cover are made of a plastic material.

3. The dispensing container of claim 1 wherein said cover has a domed configuration in side elevation.

4. The dispensing container of claim 1 wherein said lug means has a length which is a minor fraction of the periphery of said cover to form said substantially continuous peripheral channel.

5. The dispensing container of claim 1 wherein said cooperating fastening means includes mating hook and eye members.

* * * * *